United States Patent [19]

Levering

[11] 3,970,303

[45] July 20, 1976

[54] GAME AND TOY APPARATUS

[75] Inventor: Richard M. Levering, Bellmore, N.Y.

[73] Assignee: Lawrence Peska Associates, Inc., New York, N.Y. ; a part interest

[22] Filed: June 19, 1975

[21] Appl. No.: 588,490

[52] U.S. Cl. ..... 273/1 R; 35/22 R; 124/1; 273/95 A

[51] Int. Cl.[2] ..... A63F 9/00; A63B 67/00

[58] Field of Search ..... 273/1 R, 1 E, 95 A, 273/95 AA; 124/1; 35/22 R

[56] References Cited

UNITED STATES PATENTS

| | | | |
|---|---|---|---|
| 2,458,668 | 1/1949 | Wood | 273/95 A UX |
| 2,834,597 | 5/1958 | Ylinen | 273/1 R X |
| 3,545,749 | 12/1970 | Schmued | 273/1 R |
| 3,747,589 | 7/1973 | Harrison et al. | 273/1 R X |

*Primary Examiner*—Paul E. Shapiro

[57] ABSTRACT

A game of chance, skill and coordination including the catching of a dropping ball or the like released from a horizontally mounted revolving shaft; the revolution of the shaft and the catching being accomplished with the same hand.

8 Claims, 5 Drawing Figures

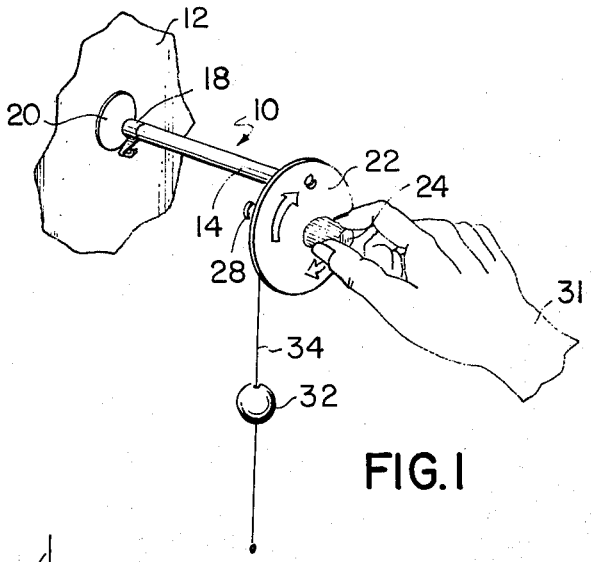
FIG.1
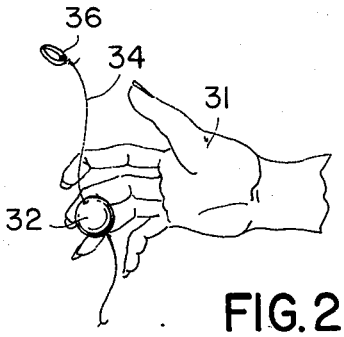
FIG.2
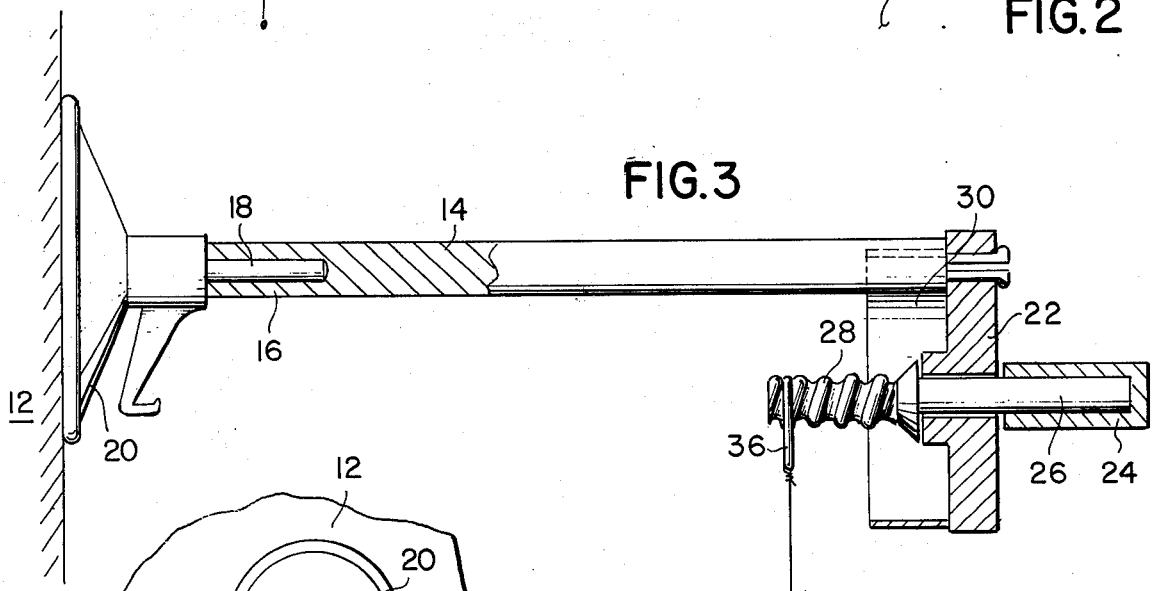
FIG.3
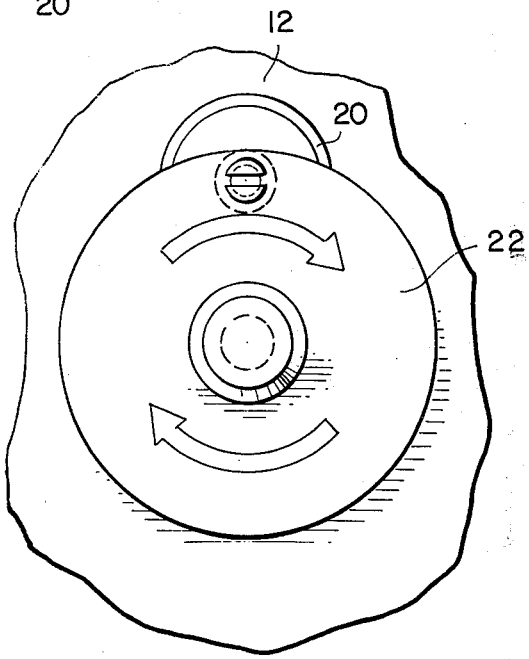
FIG. 5
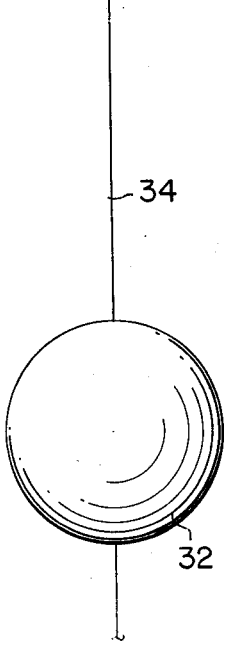
FIG.4
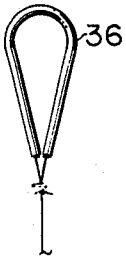

GAME AND TOY APPARATUS

BACKGROUND OF THE INVENTION

This invention relates to a game and toy apparatus; more particularly to the catching of a dropping object such as ball with the same hand that is employed to provide the impetus for the ball to drop.

The game and apparatus therefore are adapted to serve as a game, a sparing partner, a challenge, an aid, and a test of reaction timing. The unpredictable drop of a ball is the visual trigger stimulus and the catching of the ball with the same hand responsible for its release is the challenge.

The apparatus can train and challenge an individual's visual motor reaction timing; while the boxers speed bag and skip rope can be utilized with the eyes closed, it is more a test of rhythm and sound than visual alertness.

As the instant ball is variously positioned the challenge requires a degree of relaxed concentration identical to that needed by karati competitors. Soon the player can turn on this state of control and alertness by merely thinking of the ball and in so doing be a better competitor in any challenge sport or game.

The prior art is replete with all types of games involving coordination of the hands with a moving object, such as a ball. For example, U.S. Pat. Nos.: 2,754,123; 2,792,225; 2,882,054; 2,948,533; 3,315,964; 3,687,453; 3,770,272; 3,825,262; and others. All of the prior art devices are deficient, however, in that they fail to truely pit the user's eye against the speed and coordination of his hand.

SUMMARY OF THE INVENTION

It is accordingly an object of the invention to avoid one or more drawbacks of the prior art.

It is another object of the invention to provide for a game and toy apparatus.

These and other objects of the invention will become more apparent from the following detailed disclosure and claims and by reference to the accompanying drawings, in which:

FIG. 1 is a side elevational view of the game about to begin;

FIG. 2 is a view of the termination of the game;

FIG. 3 is a side elevational view of the apparatus, partly in perspective;

FIG. 4 is a front elevational view of one end of a piece of the apparatus; and

FIG. 5 is a front plan view of the apparatus.

Broadly speaking, the invention includes the provision of a toy and game apparatus comprising an elongated shaft, a first end of the shaft terminating in means to removable mount the same to a vertical support, the second end of the shaft terminating in an eccentrically mounted shield, the shield defining a substantially centrally disposed aperture therein, a second shaft disposed in the aperture and being journalled for rotational movement therein, a first end of the second shaft communicating with a knurled knob, a second end of the second shaft communicating with a threaded column, the column being operative for rotational movement of the second shaft when the knob is rotated, a tether cord having a predetermined length and looped means on one end thereof, the looped means adapted to engage the threaded column, a weighted object slidably positioned along the length of the tether cord, and a method of playing the same.

DETAILED DESCRIPTION

Referring more particularly to the drawings there is shown the instant apparatus 10, horizontally mounted to a vertical support 12 such as a wall or the like. The apparatus 10 comprises an elongated shaft 14 having at least a recess 16 at one end thereof. If desired the shaft 14 may be hollow. The recess 16 will accommodate a further shaft 18 that terminates in means 20 for removably affixing the apparatus to the wall 12 such as a suction cup or the like. Of course, the shaft 14 can communicate directly with means 20, however, for purposes of stability and balance, it is preferable that the means 20 and shaft 14 be separated. The opposite end of shaft 14 will terminate in a shield 22 such as disk or plate or the like that is eccentrically mounted on said shaft 14. The function of the shield 22 being to obstruct the view of the apparatus 10. The shield 22 will include a knurled knob 24 or the like affixed to a rotatable shaft 26; the shaft 26 being in disposed substantially in the center of said shield 22. The shaft 26 will communicate with said knob 24 on one side of said shield 22 and a threaded column 28, i.e., screw threaded on the opposite side of said shield 22 by being disposed for journal through a substantially centrally located aperture in said shield 22.

It is preferable that the screw 28 at its point of communication with the shaft 26 be obscured by a flange 30 disposed around the circumference of said shield 22. The shaft 26 and screw 28 are journalled for rotation by hand 31 movement of the knurled knob 24. A weighted object 32 such as a ball or the like is disposed frictionally along the length of a flexible tether cord 34. Preferably the cord 34 passes through the body of the object 32 thereby providing for an interrupted length of cord 34. One end of the cord 34 preferably is looped 36 or contains a nylon sleeve around the loop 36 to facilitate the movement of the same. The looped end 36 is placed on the far end, nearest the shield 22, and the knob 24 rotated until such time that the looped end 36 moves along the threads of the screw 28 and disengages therefrom such that the weighted object 32 and cord 34 are frictionally released and gravitationally brought down towards the ground, whereupon they are meant to be caught, prior to the object 32 touching the ground; that is caught by the same hard 31 that rotated the shaft 26 and caused the object 32 to be released.

An example of setting up the apparatus 10 and playing the game is as follows.

The means 20 such as a suction cup is attached to any smoothe non-porous surface such as glass, metal, tile or enamel at approximately the player's height above the floor. The screw 28 must be below the shaft 14. The loop 36 is placed anywhere on the screw 28 and the object 32 is positioned as desired by sliding it up or down on the cord 34 which runs through it; the lower the object 32 on the card 34 the greater the challenge. The player takes a position directly in front of the knurled knob 24 with knees slightly bent and eyes level with and approximately one foot from the object 32. With the same hand 31 the player wishes to use for catching the object 32 the knurled knob 24 is gently rotated in a clockwise direction. As the knob 24 is turned the loop 36 will "walk the threads" slowly towards the end of the screw 28. The player must focus full attention and concentration on the object 32. No attempt should be made to peek at the screw 28 or loop 36 in order to cheat. As the eye detects the object 32 starting to fall the hand 31 must leave the knob 24 and grab the object 32 before it hits the floor.

Since it is obvious that numerous changes and modifications can be made in the above-described details without departing from the spirit and nature of the invention, it is to be understood that all such changes and modifications are included within the scope of the invention.

I claim:

1. A toy and game apparatus comprising an elongated shaft, a first end of said shaft terminating in means to removable mount the same to a vertical support, the second end of said shaft terminating in an eccentrically mounted shield, said shield defining a substantially centrally disposed aperture therein, a second shaft disposed in said aperture and being journalled for rotational movement therein, a first end of said second shaft communicating with a knurled knob, a second end of said second shaft communicating with a threaded column, said column being operative for rotational movement upon the journal movement of said second shaft when said knob is rotated, a tether cord having a predetermined length and looped means on one end thereof, said looped means adapted to engage said threaded column, a weighted object slidably positioned along the length of said tether cord.

2. The toy as defined in claim 1 wherein said removable mounting means is a suction cup.

3. The toy as defined in claim 1 further including means communicating said shaft with said mounting means.

4. The toy as defined in claim 1 wherein said threaded column is a threaded screw.

5. The toy as defined in claim 1 wherein said weighted object is a ball.

6. The toy as defined in claim 1 wherein said loop means are unitary with said cord.

7. The toy as defined in claim 1 wherein said weighted object defines an aperture frictionally engaging said cord therein for slidable movement.

8. A method of playing the game as defined in claim 1 comprising horizontally mounting said apparatus on a vertical support above a floor at approximately the height of a player, positioning said tether cord including said object on said apparatus by engaging said column by said loop means, rotating said knurled knob until such time that the cord and object are released from said column and catching said object prior to the same reaching the floor with the hand used to rotate said knob.

* * * * *